US006006055A

United States Patent [19]

Furuya

[11] Patent Number: 6,006,055

[45] Date of Patent: Dec. 21, 1999

[54] IMAGE FORMING APPARATUS

[75] Inventor: Tadashi Furuya, Susono, Japan

[73] Assignee: Canon Kabushiki Kashia, Tokyo, Japan

[21] Appl. No.: 09/144,200

[22] Filed: Aug. 31, 1998

[30] Foreign Application Priority Data

Aug. 29, 1997 [JP] Japan ..... 9-249748

[51] Int. Cl.[6] ..... G03G 15/30

[52] U.S. Cl. ..... 399/149; 399/148

[58] Field of Search ..... 399/148–150; 361/225, 230, 214

[56] References Cited

U.S. PATENT DOCUMENTS

| | | | |
|---|---|---|---|
| 5,066,982 | 11/1991 | Hosoya et al. | 399/150 |
| 5,124,757 | 6/1992 | Ikegawa | 399/148 |
| 5,200,789 | 4/1993 | Oshiumi | 399/18 |
| 5,231,456 | 7/1993 | Kikuchi et al. | 399/150 |
| 5,323,215 | 6/1994 | Ohtaka et al. | 399/89 |
| 5,333,041 | 7/1994 | Ito et al. | 399/149 |
| 5,438,397 | 8/1995 | Okano et al. | 399/150 |
| 5,497,224 | 3/1996 | Ishikawa et al. | 399/354 |
| 5,610,697 | 3/1997 | Arai | 399/149 |
| 5,666,192 | 9/1997 | Mashimo et al. | 399/174 |
| 5,678,142 | 10/1997 | Saegusa | 399/150 X |
| 5,701,559 | 12/1997 | Ootaka et al. | 399/149 |
| 5,751,405 | 5/1998 | Aita et al. | 399/150 |
| 5,765,076 | 6/1998 | Ogata et al. | 399/149 X |

FOREIGN PATENT DOCUMENTS 0 766 146 A2 4/1997 European Pat. Off. .

*Primary Examiner*—Matthew S. Smith

*Attorney, Agent, or Firm*—Fitzpatrick, Cella, Harper & Scinto

[57] ABSTRACT

An image forming apparatus includes a movable image bearing member, a charging member, a developer, and an auxiliary member. The charging member contacts the image bearing member to electrically charge the image bearing member. The developer develops, with toner, an electrostatic image formed on the image bearing member using a charging operation of the charging member. The developer is capable or removing residual toner from the image bearing member simultaneously with its developing operation for the electrostatic image. The auxiliary member is disposed upstream of the charging position and downstream of a transfer position where the toner image is transferred from the image bearing member onto a transfer material with respect to a movement direction of the image bearing member. The auxiliary member is supplied with a voltage having a polarity opposite from a charge polarity of the charging member or is supplied with OV so that residual toner is charged to the opposite polarity and reaches the charging position. The voltage applied to the auxiliary member is more toward the opposit polarity side when a region of the image bearing member, which is going to be a non-image region, is at a position of the auxiliary member then when a region of the image bearing member, which is going to be an image region, is at the position of the auxiliary member.

7 Claims, 4 Drawing Sheets

IMAGE FORMING APPARATUS

FIELD OF THE INVENTION AND RELATED ART

The present invention relates to an image forming apparatus including a charging member contactable to an image bearing member to charge the image bearing member such as a photosensitive member or dielectric member.

An image forming apparatus such as a transfer type, electrostatic recording apparatus or the like is known wherein a toner image is formed through an image formation process including a process of uniformly charging the image bearing member such as an electrophotographic photosensitive member, electrostatic recording dielectric member or the like, and the toner image is transferred onto a recording material, and the image bearing member is repeatedly used for the image formation. In such an apparatus, a cleanerless type has been proposed wherein the cleaning operation for removing from the image bearing member the residual untransferred toner after the transfer of the image onto the image bearing member is effected by the charging device and/or the developing device(simultaneous charging and cleaning and/or simultaneous development and cleaning), by which the exclusive cleaning device is omitted for the purpose of downsizing of the apparatus.

b) On the other hand, corona charging means has been widely used as the uniform charging means for the image bearing member. The corona discharge device is disposed opposed to the image bearing member without contact thereto, and the image bearing member surface is exposed to a corona shower discharged from the corona discharge device to uniformly charge it to a predetermined polarity and potential.

Recently, from the standpoint of environmental health, a contact charging device having an advantage of small ozone product, low voltage and low electric power becomes widely used. In this type, an electroconductive charging device (contact charging member) in the form of a roller, blade, fur brush, magnetic brush or the like, is contacted to the image bearing member, and the contact charging device is supplied with a predetermined charging bias voltage, so that image bearing member surface is uniformly charged to a predetermined polarity and potential.

The charging roller(charging roller, charging roller) is an electroconductive elastic roller member having a core metal functioning as an electric energy supply electrode and a rubber member thereon having an adjusted resistance, and it is contacted to the surface of the image bearing member as the member to be charged. It is rotated by a driving system or by the member to be charged, while a charging bias voltage is applied to the core metal, by which the image bearing member surface is charged uniformly to a predetermined polarity and potential.

The charging blade comprises an electrode plate and an electroconductive elastic material of electroconductive rubber or the like thereon, and the free end of the blade is contacted to the surface of the image bearing member as the member to be charged, and the electrode plate is supplied with a charging bias voltage, so that image bearing member surface is uniformly charged to a predetermined polarity and potential.

The fur-brush charging device is a rotary type or non-rotatable type brush member of electroconductive fibers, and the electroconductive fiber brush portion(furbrush portion) is contacted to the surface of the image bearing member as the member to be charged, and a charging bias voltage is applied, so that image bearing member surface is uniformly charged to a predetermined polarity and potential.

The magnetic brush charging apparatus comprises a rotatable or non-rotatable supporting member functioning also as an electric energy supply electrode, and magnetic particles (electroconductive magnetic particles) magnetically confined in the form of a magnetic brush portion, and the magnetic brush portion of the magnetic particles is contacted to the surface of the image bearing member as the member to be charged, and a charging bias voltage is applied to the supporting member, by which the image bearing member surface is uniformly charged to a predetermined polarity and potential.

c) A cleanerless type image forming apparatus has been proposed wherein from the standpoint of both of the downsizing of the image forming apparatus and the environmental health, the charging of the image bearing member (photosensitive member) is effected by the contact charging device, and a cleaning device exclusively for removal of the untransferred toner from the photosensitive member surface after toner image transfer onto the recording material, is not provided, and the untransferred toner is at least temporarily collected by the contact charging device.

In such an image forming apparatus, the untransferred toner on the photosensitive member surface after toner image transfer onto the recording material in the transfer portion, is carried over, by the continuing movement of the photosensitive member surface, to a charging portion where the contact charging device is contacted to the photosensitive member(charging region or charging nip), and is at least temporarily collected from the photosensitive member surface to the contact charging device (simultaneous charging and cleaning). The toner not collected by the contact charging device and passed through the charging portion and the toner partly discharged from the contact charging device to the photosensitive member, are carried to the developing device by the continuing movement of the photosensitive member surface, and are collected by the developing device (simultaneous development and cleaning). More particularly, the toner is collected by a potential difference back for fog removal which is a potential difference between the DC voltage applied to the developing device in the next development operation and the surface potential of the photosensitive member.

The untransferred toner whose charge polarity is reversed in the transfer portion by the temporary collection of the untransferred toner to the contact charging device, are recharged to the regular charge polarity, and the untransferred toner pattern is scraped, so that production of the ghost image of the untransferred toner pattern is prevented.

Such a contact charging type, transfer type and cleanerless type image forming apparatus is not provided with an independent and exclusive cleaning device for removal of the untransferred toner from the photosensitive member surface, and therefore, the advantage from the standpoint of space is significant, and the significant downsizing of the apparatus is accomplished, and in addition, the amount of the ozone product by the discharge is small. The untransferred toner is collected eventually by the developing device and is reused in the subsequent process or processes, so that residual toner can be minimized, and therefore, it is desirable from the standpoint of environmental health.

It has been proposed in U.S. patent application No. 08/832861 that in an image forming apparatus of a cleanerless type wherein the untransferred toner is temporarily collected to the contact charging device, an auxiliary member is contacted to the photosensitive member surface, and the auxiliary member being a fixed furbrush between the transfer portion and the charging portion at a downstream of the transfer portion with respect to the movement direction of the photosensitive member surface to enhance the collection property of the untransferred toner.

The auxiliary member has a function of disturbing the untransferred toner into a non-pattern form. More positively, it may be supplied with an opposite bias having a polarity opposite from the charging bias, so as to trap only the untransferred toner having the same polarity as the charging bias which is not easily collected by the charging portion, and change the polarity thereof, and then discharges it, by which the collection property of the untransferred toner is improved. By this process, the ghost image is further reduced.

The deposition and mixing of the toner having a high resistance into the contact charging device(toner contamination of the contact charging device) increases the resistance value of the contact charging device to decrease the charging property.

Therefore, in the image forming apparatus wherein the untransferred toner is at least temporarily collected by the contact charging device, it is desirable that toner contamination of the contact charging device by the collected toner is maintained below an allowable level.

For example, the magnetic brush charging apparatus is not easily influenced by the toner contamination as compared with the contact charging device such as a charging roller or furbrush charging device or the like. Actually, however, by the imbalance between the toner amount collected (deposition or mixing) by the magnetic brush portion and the toner amount discharged from the magnetic brush portion, the toner amount is integrated in the magnetic brush portion with repeated operations, even beyond the allowable level with the result of the decrease of the charging property by the increase of the resistance value of the magnetic brush portion.

It is known to provide a charging member cleaning mode wherein the introduced toner is discharged onto the photosensitive member from the contact charging device during non-image formation in which the image forming apparatus does not form the image, by which the toner-contaminated state is maintained at a level lower than the allowable level(EP-A-766146).

More particularly, the applied voltage to the contact charging device is adjusted to provide a potential difference $\Delta V$ between the contact charging device and the photosensitive member, and by the potential difference, the high resistance toner mixed to the contact charging device is discharged to the photosensitive member, and is collected by the developing zone.

If, however, the potential difference $\Delta V$ is not sufficient, the introduced toner is not sufficiently discharged with the result of deterioration of the charging property and therefore the deteriorated image quality.

SUMMARY OF THE INVENTION

Accordingly, it is a principal object of the present invention to provide an image forming apparatus wherein the toner discharging from the charging member to the image bearing member is always sufficient and assured.

It is another object of the present invention to provide an image forming apparatus wherein the improper charging due to a large amount of toner deposited to the charging member, is prevented to accomplish satisfactory image formation.

It is a further object of the present invention to provide an image forming apparatus wherein a ghost image is prevented by means of an auxiliary member.

It is a further object of the present invention to provide an image forming apparatus wherein movement of the toner from the charging member to the image bearing member is made easier by means of an auxiliary member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment (1) Example of image forming apparatus

Figure 1:
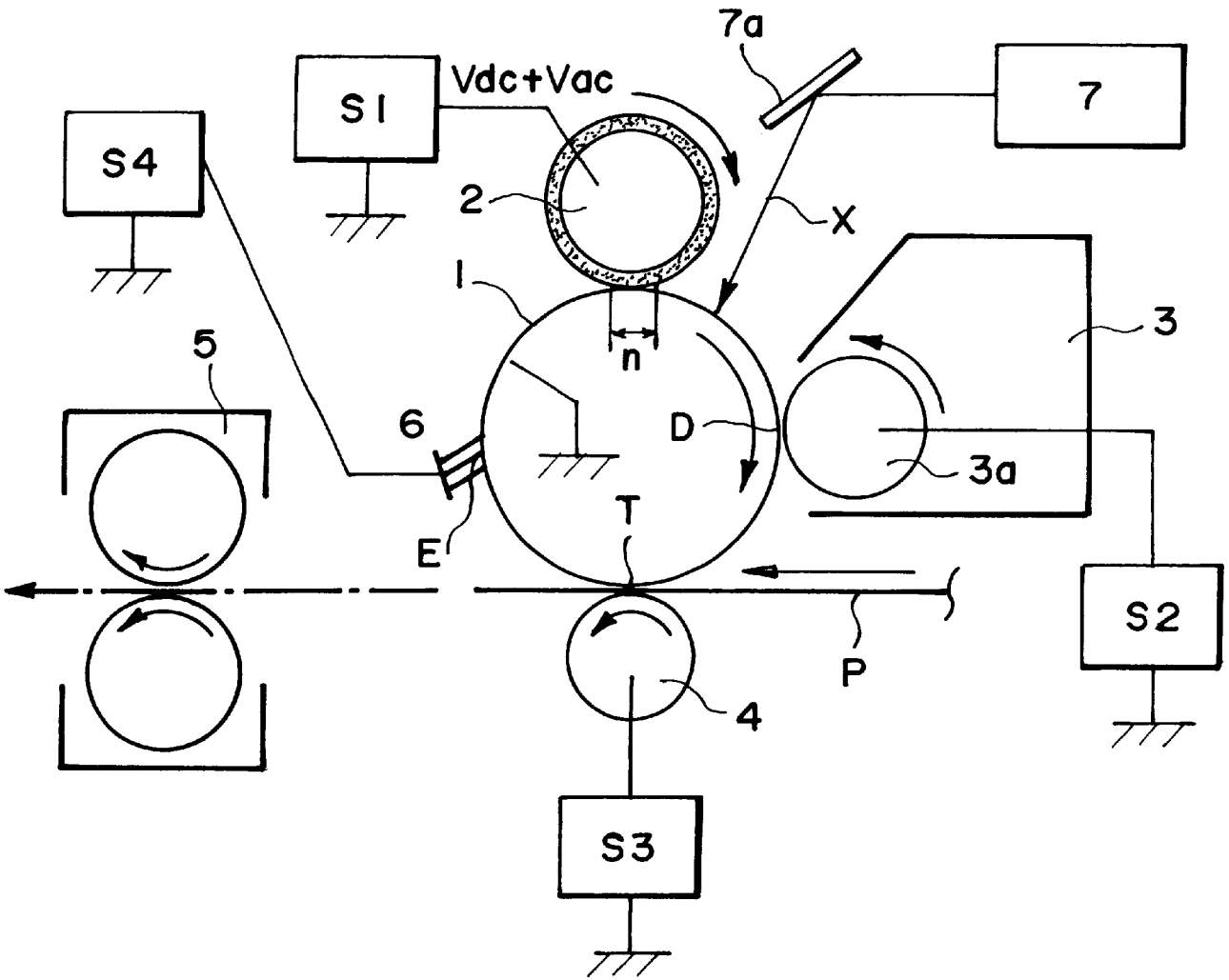
FIG. 1 is a schematic illustration of an image forming apparatus according to a first embodiment of the present invention.

FIG. 1 is a schematic illustration of an image forming apparatus of this embodiment. The image forming apparatus of this example is a magnetic brush charging and cleanerless type laser beam printer using an image transfer type electrophotographic process.

Designated by 1 is a rotatable drum type electrophotographic photosensitive member as an image bearing member (member to be charged). The photosensitive member 1 is rotated at a predetermined process speed (peripheral speed) in the clockwise direction indicated by an arrow. In this embodiment, the peripheral speed is 100 mm/sec.

Designated by 2 is a contact charging device contacted to the photosensitive member 1 (contact charging member). The contact charging device 2 of the example is a magnetic brush charging apparatus (magnetic brush charging member) of a rotatable sleeve type. Designated by n is a charging portion (charging region or charging nip) where the magnetic brush charging apparatus 2 is contacted to the photosensitive member 1. The magnetic brush charging apparatus 2 will be described in section (2) hereinafter.

The magnetic brush charging apparatus 2 is supplied with a predetermined charging bias in the form of a sum of a DC bias Vdc and an AC bias Vac (oscillating voltage which is a voltage having a voltage level which periodically changes with time) from a charging bias applying voltage source S1, so that outer surface of the rotatable photosensitive member 1 is charged uniformly to a predetermined polarity and potential. The DC bias component Vdc is substantially equal to the desired charged potential of the member to be charged, and in this embodiment, the DC bias component Vdc is −700 V.

The charged surface or the rotatable photosensitive member 1 is exposed to a laser beam scanning exposure X by a laser scanner 7 (exposure device), so that electrostatic latent image is formed correspondingly to the intended image information on the peripheral surface of the rotatable photosensitive member 1.

The laser scanner 7 emits a laser beam having an intensity modulated by the time series electrical digital pixel signal corresponding to the intended image information. Designated by 7*a* is a mirror for deflecting the output laser beam from the laser scanner 7 toward the image exposure portion of the photosensitive member 1.

The electrostatic latent image on the surface of the rotatable photosensitive member 1 is developed through a reverse development into a toner image in a developing zone D by a developing device 3, using insulative toner (negative charged toner) having a negative charge polarity. Designated by 3*a* is a developer carrying member in the form of a developing roller (developing sleeve), and S2 is a developing bias applying voltage source for applying a predetermined developing bias to the developing roller 3*a*. The developing bias applying voltage source S2 applies a developing bias in the form of a sum of a DC bias and an AC bias voltages. In this embodiment, DC bias is −480 V.

On the other hand, a transfer material P as a recording material is fed from an unshown sheet feeder, and is introduced at a predetermined timing into a nip (transfer portion)T where a transfer roller 4 having an intermediate resistance (contact type transferring device) is contacted to the photosensitive member 1 with a predetermined pressure and with the transfer material intervening between them. The transfer roller 4 is supplied with a transfer bias voltage having an opposite polarity from the toner by the transfer bias application voltage source S3.

The transfer material P introduced to the transfer portion T is passed through the transfer portion T, during which the toner image is sequentially transferred from the surface of the photosensitive member 1 onto the front side of the transfer material P by electrostatic force and the pressure.

The transfer material P now having the toner image, is separated from the surface of the photosensitive member 1, and is fed to a heat fixing type fixing device 5, where the toner image is fixed on the transfer material P. Finally, it is discharged as a print.

Designated by 6 is an auxiliary member contacted to the surface of the photosensitive member 1 between the transfer portion T and the charging portion n downstream of the transfer portion T with respect to movement direction of the photosensitive member surface. In this example, it is a stationary fur brush having an intermediate resistance. The auxiliary member 6 will be described in detail in section (3) hereinafter.

(2) Magnetic Brush Charging Apparatus 2

Figure 2:
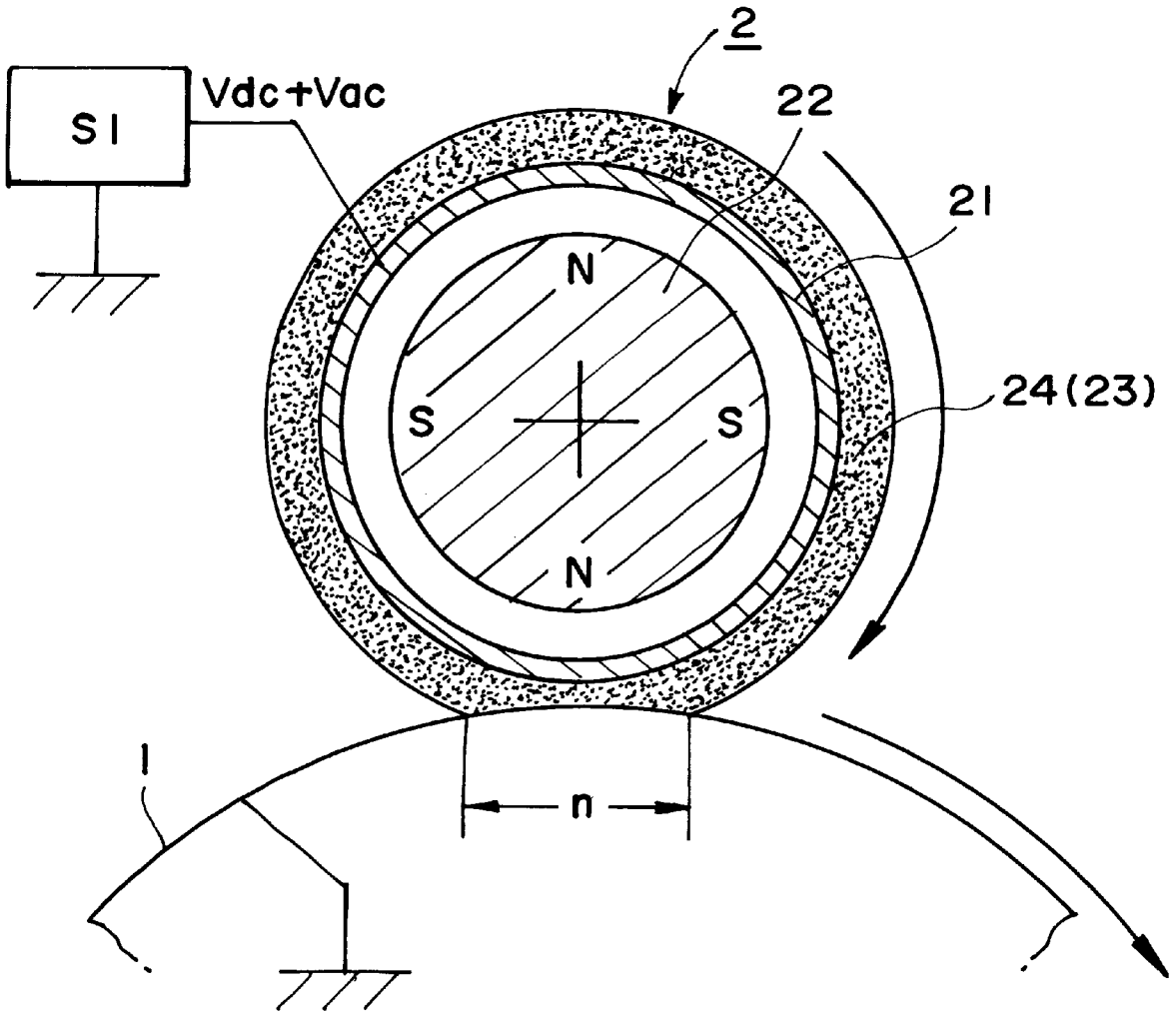
FIG. 2 is a schematic view of a magnetic brush charging apparatus of a rotatable sleeve type used as a contact charging device in the image forming apparatus of the first embodiment.

FIG. 2 is a schematic view of a magnetic brush charging apparatus 2 of a rotatable sleeve type as the contact charging device, and it comprises a stationary (non-rotatable) magnet roller 22 as magnetic field generating means, a rotatable non-magnetic electrode sleeve(electroconductive base) 21 of aluminum fitted around the magnet roller 22, and a magnetic brush layer 24 of electroconductive magnetic particles 23 magnetically attracted on the outer surface of the electrode sleeve 21 by the magnetic force of the magnet roller 22 in the sleeve.

The electroconductive magnetic particles 23 constituting the magnetic brush portion 24 may be ferrite, magnetite or another magnetic metal particles or such magnetic particles bound by resin material.

The volume resistivity of the magnetic particle 23 is preferably $1\times10^{6}$–$10^{9}$ Ωcm. The particle size thereof is preferably 10–50 μm. By mixing a plurality of magnetic particles, the charging property can be improved.

As for a resistance measurement of the magnetic particles, 2 g of the magnetic particles are placed in a cylindrical container having a bottom surface area of 228 $mm^2$, and is pressed by 15 kg. A voltage of 100 V is applied between the top and the bottom thereof, and the resistance is calculated from the current, and the obtained value is regularized.

The average particle size of the magnetic particles, is indicated by a maximum angular distance in a horizontal direction, and not less than particles 300 are randomly selected through a microscopic method, and the diameters thereof are measured, and the arithmetic average are obtained.

The magnetic brush charging apparatus 2 is disposed substantially in parallel with the photosensitive member 1 with a gap of 0.5 mm between the surface of the electrode sleeve 21 and the surface of the photosensitive member 1 by spacer members (unshown) contacted to the surface of the photosensitive member 1 at the longitudinal end portions, so that predetermined width of the magnetic brush layer 24 is contacted to the photosensitive member 1 surface to constitute a charging portion n.

The electrode sleeve 21 is rotated at the peripheral speed substantially equal to the peripheral speed of the photosensitive member 1 in the clockwise direction indicated by the arrow which is opposite from the rotational direction of the photosensitive member 1 in the charging portion n, and by this, the magnetic brush layer 24 rubs the surface of the photosensitive member 1 at the peripheral speed substantially equal to the photosensitive member 1 in the same as the electrode sleeve 21.

By the application of the predetermined charging bias Vdc+Vac (oscillating voltage) from the charging bias voltage source S1 to the electrode sleeve 21 of the magnetic brush charging apparatus 2, the surface of the photosensitive member 1 is charged to the substantially same potential (substantially −700 V in this example) as the DC bias component Vdc of the applied charging bias to the magnetic brush charging apparatus 2, in the charging portion n through the electroconductive magnetic particles 23 of the magnetic brush layer 24.

(3) Cleanerless System

Since the printer is a cleanerless printer, there is not provided an independent cleaner(cleaning device) exclusively for removing the untransferred toner remaining on the surface of the photosensitive member 1 after the toner image transfer onto the transfer material P at the transfer portion T.

As described hereinbefore, a stationary intermediate resistance fur brush as an auxiliary member is disposed contacted to the surface of the photosensitive member 1 between the transfer portion T and the charging portion n downstream of the transfer portion T with respect to the movement direction of the photosensitive member surface.

The auxiliary member 6 is supplied with an opposite bias(positive) which is opposite from the applied charging bias(negative) to the magnetic brush charging apparatus 2, from the voltage source for the auxiliary member bias S4.

The untransferred toner remaining on the photosensitive member surface after the toner image transfer onto the transfer material P at the transfer portion T, is carried over to the portion E where the furbrush 6 as the auxiliary member is contacted to the photosensitive member 1 with the rotation of the photosensitive member 1, and is disturbed by the fur brush 6 into a non-pattern form.

The auxiliary member is supplied with a positive bias, so that such toner of the untransferred toner in the contact portion E as has the polarity which is the same as the bias applied to the magnetic brush charging apparatus 2, namely, the toner having the regular charging polarity(negative toner), is trapped thereby, and is discharged to the photosensitive member 1 as positive toner. The toner particles charged to the positive polarity passes through the contact portion E of the fur brush 6, as it is.

By this, the untransferred toner carried to the charging portion n are uniformly charged to the opposite polarity (positive) from the charging bias, and the collection property of the untransferred toner from the photosensitive member 1 by the magnetic brush charging apparatus 2 is improved (simultaneous charging and cleaning). More particularly, since the untransferred toner is collected temporarily by the charging device 2, the pattern of the previous image does not remain when the next image is formed.

In this embodiment, the bias applied to the furbrush as the auxiliary member 6 is +500 V to improve the collection property of the untransferred toner in the magnetic brush charging apparatus 2 and to reduced the ghost image.

Here, the use is made with an opposite bias(positive) having a polarity opposite from that of applied bias (negative) applied to the contact charging device 2, for the bias to be applied to the auxiliary member 6. However when the transfer bias is so low that surface potential of the photosensitive member does not become positive after the image transfer from the photosensitive member 1, the applied bias to the auxiliary member 6 may be 0, and the similar advantages are provided. More particularly, when the potential of the photosensitive member is negative, and the potential of the auxiliary member is 0V, the potential of the auxiliary member is positive relative to the potential of the photosensitive member, so that negative charged toner among the untransferred toner can be charged to the positive polarity.

The positive untransferred toner collected by the magnetic brush charging apparatus 2 is charged to the negative polarity (regular charging polarity) by the friction with the electroconductive magnetic particle constituting the magnetic brush portion, and then is uniformly discharged to the surface of the photosensitive member 1 (toner discharge) as negative charged toner. Simultaneously therewith, the photosensitive member 1 is uniformly charged by the magnetic brush charging apparatus.

The toner discharged to the surface of the photosensitive member 1 from the magnetic brush charging apparatus 2, is carried to the developing zone D where the developing device 3 is opposed to the photosensitive member 1, through the image exposure portion by the rotation of the photosensitive member 1. In the image exposure portion, the photosensitive member 1 is exposed to beam from the laser scanner 7 with the toner remaining thereon to form the electrostatic latent image.

However, the toner discharged to the surface of the photosensitive member 1 from the magnetic brush charging apparatus 2 is very uniformly distributed thereon, and the amount thereof is small, so that image exposure process is not substantially influenced.

Substantially all of the untransferred toner having discharged from the magnetic brush charging apparatus 2 to the surface of the photosensitive member 1 and having reached the developing zone D, has the regular charging polarity (negative charging), and the toner deposited on the white background portion among the untransferred toner on the surface of the photosensitive member 1 in the developing process is collected into the developing device 3 by a fog removing electric field((simultaneous development and cleaning) and is reused. On the other hand, the toner deposited on the image portion is partly used for the toner image formation. Thus, simultaneously with formation of the electric field effective to remove the toner to the developing sleeve from the dark portion of the electrostatic latent image, the electric field is formed to deposit the toner to the light portion of the electrostatic latent image from the developing sleeve.

In this embodiment, a developing bias in the form of a sum of a DC bias and an AC bias is applied from the developing bias applying voltage source S2 to the developing roller 3*a*, wherein the DC bias is −480 V, and by the potential difference (Vback) between the DC bias and Vdc of the charging bias, the toner discharged from the magnetic brush charging apparatus 2 is collected and is reused for the development.

(4) Charging Member Cleaning Mode

As described hereinbefore, the magnetic brush charging apparatus 2 is not easily influenced by the toner contamination as compared with the contact charging device such as a charging roller or fur brush charging device or the like. Actually, however, by the imbalance between the toner amount collected (deposition or mixing) by the magnetic brush portion and the toner amount discharged from the magnetic brush portion, the toner amount is integrated in the magnetic brush portion with repeated operation, even beyond the allowable level with the result of the decrease of the charging property by the increase of the resistance value of the magnetic brush portion.

Therefore, a charging member cleaning mode is used wherein the introduced toner is discharged onto the photosensitive member from the magnetic brush charging apparatus 2 during non-image formation in which the image forming apparatus does not form the image, by which the toner-contaminated state is maintained at a level lower than the allowable level.

In the charging member cleaning mode, the untransferred toner introduced or mixed to the magnetic brush layer 24 of the magnetic brush charging apparatus 2 is electrically discharged to the photosensitive member 1, by which the resistance of the magnetic brush layer 24 is returned to the original state, thus recovering the charging property of the magnetic brush charging apparatus 2. The toner discharged to the photosensitive member 1 is collected by the downstream developing device 3 with respect to the rotational direction of the photosensitive member 1, and is reused.

Thus, in the charging member cleaning mode, the toner in the magnetic brush charging apparatus 2 is discharged at the charging portion n and is collected by the developing zone D, and therefore, a relatively large amount of the toner on the photosensitive member 1 is passed through the exposure portion. In order to avoid the adverse influence of the toner in the exposure portion against the image exposure of the image formation, the charging member cleaning mode is carried out mainly during the non-image formation period. In other words, the toner is moved from the charging member to the region which is going to be a non-image region of the photosensitive member.

Here, the operation process of the image forming apparatus (printer) will be described.

(1) pre-multi-rotation step

Starting operation period (warming period) of image forming apparatus. In response to actuation of the main switch, the main motor (unshown) of the apparatus is operated to rotate the photosensitive member 1 and to carry out the preparing operations for predetermined process means.

After the start-up operation period, the main motor is once stopped, and therefore, the rotation of the photosensitive member 1 stops, and the apparatus is kept in a stand-by state until a print start signal is produced.

(2) pre-rotation process

This is such a period that in response to production of print start signal, the main motor is reactuated to rerotate the photosensitive member 1, and preparatory operations are carried out for a certain period.

(3) printing process (image formation process)

Upon completion of the pre-rotation process, the printing process including the charging of the rotatable photosensitive member 1, the image exposure, the development, and the toner image transfer onto the transfer material or the like through a predetermined sequence(image forming process), is carried out so that transfer material P having received the toner image is fed to the fixing device 5 (first print).

In a continuous printing mode, the printing process is repeated until the printing process is carried out for the preset number.

(4) sheet interval stroke

In the continuous printing mode, there is a on-sheet-passing period of the transfer material P in the transfer portion T, which is a duration after passing of the trailing edge of a transfer material P through the transfer portion T and before the leading edge of the next transfer material P reaches the transfer portion T.

(5) Post-rotation Process

The main motor continues to operate for a certain period after the completion of the printing process for the n-th (last) sheet, by which the photosensitive member 1 continues to rotate to carry out predetermined post-process.

After the completion of the post-rotation process, the main motor is stopped, and the rotation of the photosensitive member 1 stops. The apparatus is kept again in the stand-by state until the next print start signal is produced.

When the printing start signal is produced immediately after the completion of the pre-multi-rotation, the printing process is continuously carried out through the pre-rotation process. When only one sheet is to be printed, the apparatus is placed in the stand-by state through the post-rotation process, after the completion of the printing process. Among the above steps, the period of the printing process(3) is the image formation period, and the periods of the pre-multi-rotation (1), the pre-rotation process(2), the sheet interval(4) and the post-rotation process image forming apparatus, are non-image formation periods.

Figure 3:
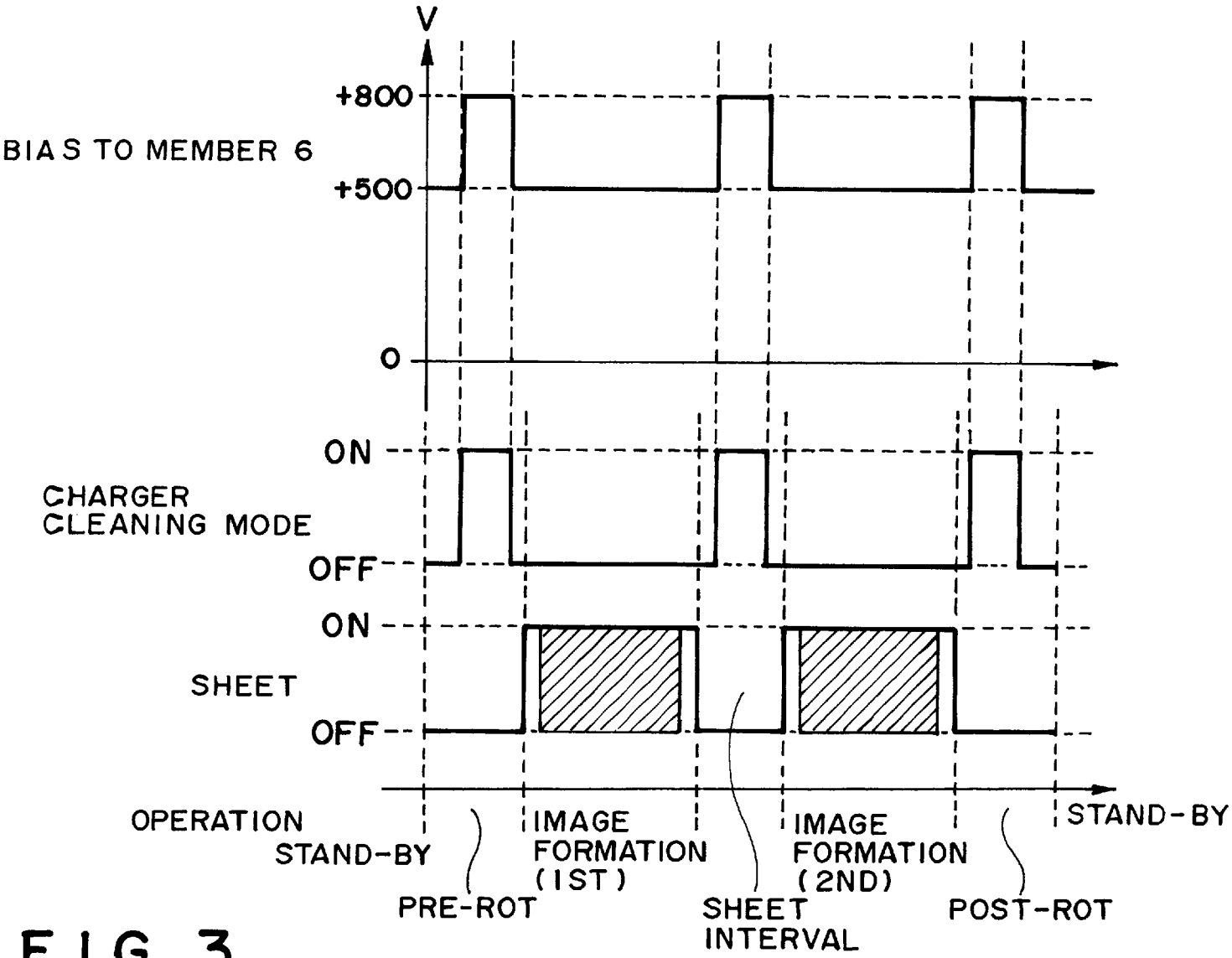
FIG. 3 is a timing chart of an applied bias to an auxiliary member and a charging member cleaning mode.

As shown in FIG. 3, in this example, the charging member cleaning mode is carried out in the period of the pre-rotation process (2), the sheet interval (4), and the post-rotation process (5) which are the non-image formation periods. FIG. 3 deals with a case of two continuous printings.

In the charging member cleaning mode, the AC component (Vac) of the charging bias applied to the magnetic brush charging apparatus 2 is stopped during such non-image-formation periods, so that toner is electrically discharged from the magnetic brush layer 24 by the potential difference ΔV between the DC component (Vdc) of the charging bias applied to the electrode sleeve 21 and the surface potential (Vd) i.e., (Vdc-Vd) of the charged photosensitive member 1. Alternatively, the peak-to-peak voltage of the AC component of the charging bias may be lowered to discharge the toner.

By the stop of the AC component (Vac) of the charging bias, the charging property for the photosensitive member 1 is decreased, so that surface potential (Vd) thereof is lowered, by which the potential difference ΔV effective to discharge the toner is increased. The untransferred toner introduced to the magnetic brush layer 24 is uniformly charged to the negative polarity by the friction with the electroconductive magnetic particle 23, and therefore, the toner is moved or discharged to the photosensitive member 1 by the potential difference ΔV.

The cleaning means for the contact charging device (contact charging member) may be any if it can discharge the introduced toner from the contact charging device. For example, the discharging may be effected by adjusting the DC component (Vdc)of the charging bias to be applied to the magnetic brush charging apparatus 2, or the discharging may be effected by adjusting the distance between the magnetic brush charging apparatus 2 and the photosensitive member 1.

As described in the foregoing, in the prior art, if the charging member cleaning mode operation is not sufficient, the introduced toner is not sufficiently discharged with the result of deterioration of the charging property and therefore the deteriorated image quality.

In consideration of this, this example is such that, as shown in FIG. 3, the voltage applied to the auxiliary member is strengthened toward the polarity which is opposite from the charge polarity of the magnetic brush charging apparatus, in the charging member cleaning mode. In order to erase the previous image pattern, the auxiliary member is supplied with a voltage (+500 V) of the opposite polarity (opposite from the charging device) or 0 V for the area which is going to be an image formation region of the photosensitive member, and in order to improve the toner discharge from the charging member to the photosensitive member in the cleaning mode, the voltage to the auxiliary member is strengthened in the direction of the opposite polarity, for the area which is going to be a non-image formation area or region of the photosensitive member. More particularly, the voltage applied to the auxiliary member is more toward the opposite polarity side (opposite from the charge polarity) when the region on the image bearing member which is going to be the non-image region is at the position of the auxiliary member than when the region of the image bearing member which is going to be the image region is at the position of the auxiliary member.

By such strengthening, the surface potential of the surface of the photosensitive member 1 lowers, and therefore, the surface potential of the photosensitive member Vd when it passes through the magnetic brush charging apparatus 2 also lowers, so that potential difference ΔV effective to discharge the toner is increased, thus improving the cleaning of the magnetic brush charging apparatus 2.

Actually, the bias applied to the auxiliary member 6 during the cleaning mode was set at +800 V, and it was confirmed that toner discharging potential difference ΔV increased from 40 V to 70 V, and the image formation was good for a long term.

The image formation process operation of the image forming apparatus including the charging member cleaning mode is controlled by an unshown control system through a predetermined sequence.

The charging member cleaning mode may be carried out at least one of the pre-rotation process period (2), the sheet interval period (4) and the post-rotation process period (5). It may be carried out in the pre-multi-rotation period.

As described in the foregoing, in this example of the image transfer type image forming apparatus of the cleanerless type using the magnetic brush charging apparatus 2, the bias applied to the auxiliary member 6 is altered for the cleaning mode for the magnetic brush charging apparatus 2, so that cleaning property for the magnetic brush charging apparatus 2 is improved, by which satisfactory image formation is accomplished.

In an injection charging type wherein the charge is directly injected into the photosensitive member surface, the applied bias Vdc and the charged potential of the photosensitive member Vd are substantially equal, and therefore, the toner discharging potential difference ΔV is small, and therefore, the cleaning of the magnetic brush charging apparatus 2 has not been sufficient. With the present invention, the effects were sufficient in the injection charging type image forming apparatus. In an injection charging type, the photosensitive member preferably has an injection layer having a volume resistivity of $10^9$–$10^{14}$ Ωcm on the photosensitive layer.

Second Embodiment

Figure 4:
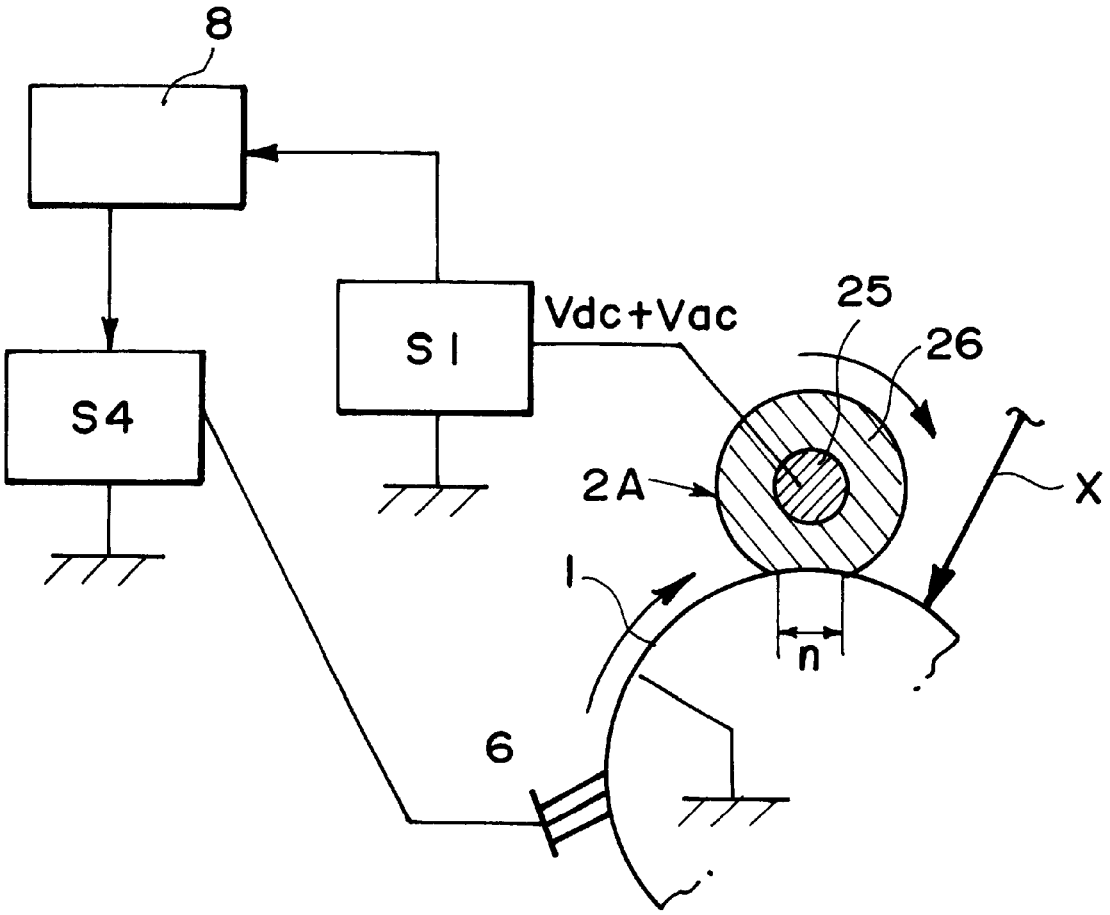
FIG. 4 is a schematic illustration of a major part of an image forming apparatus according to a second embodiment.

FIG. 4 is a schematic illustration of a major part of an image forming apparatus of this embodiment. The hardware structures of the image forming apparatus of this embodiment is the same as the image forming apparatus of the above-described first embodiment (the cleanerless type laser beam printer using the image transfer type electrophotographic process and the magnetic brush charging) except that charging roller 2A is used in place to the magnetic brush charging apparatus 2 as the contact charging device.

The charging roller 2A used in this example comprises a core metal (electroconductive base) 25 for supplying a charging bias and an urethane foam rubber layer 26 bonded thereon and abraded into a roller shape.

The urethane foam rubber layer 26 has a foam diameter of approx. 100 μm, and a hardness of 40° in Asker C hardness. Carbon is mixed into the rubber to provide a resistivity of $10^5$–$10^9$ Ωcm approx. Here, the resistivity is measured in this manner. The charging roller 2A is contacted to an aluminum drum and is rotated, while supplying a DC bias of 100 V, and the resistivity is calculated from the current at that time.

The charging roller 2A is press-contacted to the photosensitive member 1 with a predetermined pressure against the elasticity of the urethane rubber layer 26, and is disposed parallel with the axis of the photosensitive member 1. Designated by a is a charging portion (charging region or charging nip) where the charging roller 2A is contacted to the photosensitive member 1. The charging roller 2A is rotated counterdirectionally with the peripheral movement direction of the photosensitive member 1 at the charging portion n in this example, and is contact thereto with a peripheral speed difference between the surface of the photosensitive member 1. The charging roller 2A may be driven by the photosensitive member 1, or it may be rotated codirectionally with the rotation of the photosensitive member.

The core metal 25 of the charging roller 2A is supplied with a predetermined charging bias from a voltage source S1 so that surface of the rotatable photosensitive member 1 is contact-charged.

In an image forming apparatus of the cleanerless type using such a charging roller 2A, the toner introduced to the charging device is deposited to the surface of the roller, as contrasted to the magnetic brush charging apparatus 2 of the image forming apparatus according to the first embodiment, and therefore, the charging property immediately lowers.

In this example, in consideration of this, there are provided two levels of bias voltage to be applied to the auxiliary member 6 during the charging member cleaning mode, and the applied bias value to the auxiliary member 6 is changed in accordance with the toner amount deposited to the charging roller 2A.

The toner amount deposited to the charging roller 2A, namely, the degree of the toner contamination of the charging roller 2A, is related with the charging current. In this example, therefore, the charging current is measured by a control circuit 8, and the bias level to be applied to the auxiliary member 6 from the voltage source S4 during the charging member cleaning mode, is changed in accordance with the measured charging current. For the region of the photosensitive member which is going to be an image formation region, the auxiliary member is supplied with +500 V, similarly to first embodiment.

More particularly, in this example, the charging current is measured by a control circuit 8, and when the charging current is threshold value of 20 μA or higher, the applied bias to the auxiliary member 6 from the voltage source S4 during the charging member cleaning mode is set to +800 V, and when it is lower than 20 μA, the applied bias to the auxiliary member 6 is set at +1200 V, by which the cleaning property of the charging roller 2A is improved. The voltage applied to the auxiliary member is more toward the opposite polarity side (opposite from the charge polarity) when the region on the photosensitive member which is going to be the non-image region is at the position of the auxiliary member than when the region of the photosensitive member which is going to be the image region is at the position of the auxiliary member.

By this, the cleaning property is so improved that good images are provide even after 2000 sheets are printed (in the prior art, image defect occurs after 200 sheets print).

In this example, one threshold level(20 μA), and two levels for the bias applied to the auxiliary member (+800 V, +1200 V), are provided, but more levels may be provided for each of them. In this example, the urethane rubber is used for the material of the charging roller 2A, but this is not limiting, and if the above-described resistance range is satisfied, various materials are usable. For example, EPDM rubber or NBR rubber are usable.

In this example, the toner amount (degree of toner contamination of the charging device) is detected using the charging current, but this is not limiting, and any detection method is usable if it can detect the state of toner contamination of the charging device. For example, in an image forming apparatus using a digital signal, the consumption of toner may be calculated using the signal, and the toner amount introduced into the charging device can be estimated therefrom.

Others

1) The magnetic brush charging apparatus 2 as the contact charging device is not limited to the rotatable sleeve type. Other examples include a rotatable magnet roller, or a sleeveless type wherein the surface of the magnet roller is treated for electroconductivity and is used as an electric energy supply electrode, and the electroconductive magnetic particles are directly confined on the outer surface of the magnet roller to form a magnetic brush portion, and wherein the magnet roller is rotated. A nonrotatable magnetic brush member is also usable.

The contact charging device is not limited to the above-described magnetic brush charging apparatus 2 or the charging roller 2A, but a charging blade, fur brush charging device or the like is usable.

2) The auxiliary member 6 is not limited to a stationary furbrush, but may be a rotatable roller type. The material thereof is not limited to the fur brush, but another material such as a stationary or rotatable electroconductive sponge member is usable. The auxiliary member may be a corona discharger to change the polarity of the residual toner to the positive polarity from the negative polarity.

3) The voltage waveform of the AC bias to the contact charging device 2 or 2A or the developing device or the like, may be a sinusoidal wave, a rectangular wave, a triangular wave or the like. Also, the alternating current may be constituted of an alternating current in the rectangular form which is generated by periodically turning on and off a DC power source. In other words, the waveform of the alternating voltage applied, as the charge bias, to a charging member or a development member may be optional as long as the voltage value periodically changes.

4) The image exposure means for the electrostatic latent image formation is not limited to the digital means, but may be analog image exposure means or may use LED or another light emitting element. It may be a combination of a light emission element such as a fluorescent lamp and a liquid crystal shutter or the like, if an electrostatic latent image can be formed corresponding to the image information.

The image bearing member may be an electrostatic recording dielectric member or the like. In such a case, the dielectric member surface is uniformly charged (primary charging) to a predetermined polarity and potential, and thereafter, the selective discharging is effected by discharging needle head, electron gun or another discharging means to form an intended electrostatic latent image.

5) The developing system or the structure of the developing device may be another one. A regular developing means is usable.

6) The recording material for receiving the developer image from the image bearing member 1 may be an intermediary transfer member such as a transfer drum.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a movable image bearing member;

a charging member contactable to said image bearing member to electrically charge said image bearing member;

developing means for developing with toner an electrostatic image formed on said image bearing member using charging operation of said charging member, said developing means being capable of removing residual toner from said image bearing member simultaneously with its development operation for the electrostatic image; and an auxiliary member, disposed upstream of said charging position and downstream of a transfer position where the toner image is transferred from said image bearing member onto a transfer material with respect to a movement direction of said image bearing member, said auxiliary member being supplied with a voltage having a polarity opposite from a charge polarity of said charging member or supplied with OV so that residual toner is charged to the opposite polarity and reaches said charging position;

wherein the voltage applied to said auxiliary member is more toward the opposite polarity side when a region of said image bearing member which is going to be a non-image region is at a position of said auxiliary member than when a region of said image bearing member which is going to be an image region is at the position of said auxiliary member.

2. An apparatus according to claim 1, wherein the voltage applied to said auxiliary member when the region of said image bearing member which is going to be the non-image region is at the position of said auxiliary member, is selectable from at least two levels of voltages.

3. An apparatus according to claim 1, wherein said charging member includes a magnetic brush of magnetic particles contactable to said image bearing member.

4. An apparatus according to claim 1, wherein said charging member includes an elastic roller.

5. An apparatus according to claim 1, wherein the charge polarity of said charging member and a regular charge polarity of the toner are the same.

6. An apparatus according to claim 1, wherein said auxiliary member charges toner, having the same polarity as the charge polarity of said charging member, of the residual toner to the opposite polarity.

7. An apparatus according to claim 1, wherein said auxiliary member is contactable to said image bearing member.

* * * * *

UNITED STATES PATENT AND TRADEMARK OFFICE

CERTIFICATE OF CORRECTION

PATENT NO. : 6,006,055

DATED : December 21, 1999

INVENTOR(S) : TADASHI FURUYA

It is certified that error appears in the above-identified patent and that said Letters Patent is hereby corrected as shown below:

ON THE COVER PAGE

[57] ABSTRACT

Line 10, "capable or" should read --capable of--; and

Line 25, "then" should read --than--.

COLUMN 1

Line 62, "fur-brush" should read --fur brush--; and

Line 65, "portion(furbrush" should read --portion (fur brush)--.

COLUMN 2

Line 41, "back" should read --Vback--.

UNITED STATES PATENT AND TRADEMARK OFFICE

CERTIFICATE OF CORRECTION

PATENT NO. : 6,006,055

DATED : December 21, 1999

INVENTOR(S) : TADASHI FURUYA

It is certified that error appears in the above-identified patent and that said Letters Patent is hereby corrected as shown below:

COLUMN 3
Line 18, "device(toner" should read --device (toner--.

COLUMN 4
Line 53, "section" should read --Section--.

COLUMN 5
Line 47, "section" should read --Section--.

COLUMN 7
Line 18, "reduced" should read --reduce--; and
Line 22, "However" should read --However,--.

COLUMN 9
Line 20, "on-sheet-" should read --non-sheet- --.

UNITED STATES PATENT AND TRADEMARK OFFICE

CERTIFICATE OF CORRECTION

PATENT NO. : 6,006,055

DATED : December 21, 1999

INVENTOR(S) : TADASHI FURUYA

It is certified that error appears in the above-identified patent and that said Letters Patent is hereby corrected as shown below:

COLUMN 11

Line 40, "a" (first occurrence) should read --n--; and
Line 45, "contact" should read --contacted--.

COLUMN 12

Line 28, "provide" should read --provided--; and
Line 30, "level(20μA)" should read --level (20μA)--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*